US006490552B1

(12) United States Patent
Lee et al.

(10) Patent No.: US 6,490,552 B1
(45) Date of Patent: Dec. 3, 2002

(54) METHODS AND APPARATUS FOR SILENCE QUALITY MEASUREMENT

(75) Inventors: K. Y. Martin Lee, San Francisco, CA (US); Wei Ma, Castro Valley, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/413,579

(22) Filed: Oct. 6, 1999

(51) Int. Cl.[7] ..... G10L 19/06
(52) U.S. Cl. ..... 704/209; 704/228
(58) Field of Search ..... 704/207, 226, 704/228, 233, 209

(56) References Cited

U.S. PATENT DOCUMENTS 5,794,188 A * 8/1998 Hollier ..... 704/228
6,275,794 B1 * 8/2001 Benyassine et al. ..... 704/207

OTHER PUBLICATIONS

Objective quality measurement of telephone–band (300–3400 Hz) speech codecs, International Telecomunication Union ITU–T p. 861 (02/98).*

Crochiere, R. E., "An analysis of 16 Kb/s sub–band coder performance: dynamic range, tandem connections, and channel errors," Bell System Technical Journal, 1978, 57, (8), pp. 2927–2952.*

Wang, S. et al., "An Objective Measure for Predicting Subjective Quality of Speech Coders," IEEE Journal on Selected Areas in Communications, vol. 10. No. 5, Jun. 1992.*

Dimolitsas, S., "Objective speech distortion measures and their relevance to speech quality assessments," IEE Proceedings, vol. 136, Pt. I, No. 5, Oct. 1989.*

* cited by examiner

*Primary Examiner*—Marsha D. Banks-Harold
*Assistant Examiner*—V. Paul Harper
(74) *Attorney, Agent, or Firm*—Armstrong Teasdale LLP

(57) ABSTRACT

Perceptual quality of a processed signal obtained by processing an original signal having silent periods is evaluated. Silent portions and speech portions of the original signal and corresponding silent portions and speech portions of the processed signal are identified, and the silent portions of the processed signal are evaluated in accordance with a function of amounts of energy contained in the silent portions of the processed signal, corresponding silent portions of the original signal, and an amount of energy in speech portions of the original signal. In one embodiment, the original signal and the processed signal are segmented into frames, frames of the original signal that represent speech and frames of the original signal that represent silence are identified, and the evaluation produces a mean opinion score (MOS).

51 Claims, 3 Drawing Sheets

METHODS AND APPARATUS FOR SILENCE QUALITY MEASUREMENT

BACKGROUND OF THE INVENTION

This invention relates generally to methods and apparatus for objective perceptual quality measurement of an audio signal, and more particularly to methods and apparatus for measuring distortions introduced in silent passages by processing of speech signals.

Some objective measures of speech signal quality are known. For example, International Telecommunications Union (ITU) standard P.861 for Perceptual Speech Quality Measurement (PSQM) of voice signals is a perceptual objective algorithm for measuring quality of voice signals. This quality measurement is of interest, for example, when compressing and decompressing a voice signal through speech codecs.

Known perceptual speech quality measurement algorithms require both an original and a processed signal to be available. For example, PSQM computes a "perceptual difference" between an original and a processed signal to give an objective value that can be mapped to a Mean Opinion Score (MOS). PSQM and other known algorithms operate on active speech portions of the original signal. However, the assumption that only active speech portions contribute to an MOS value is correct only under special conditions. For example, when one attempts to characterize distortion introduced by a new speech compression algorithm, one simply processes an original speech signal through a codec and measures a difference between the original speech signal and the processed signal. There is very little distortion content during silent periods in such processing, resulting in no contribution by such periods to a MOS value.

However, when one is attempting to characterize an effect of other types of processors, for example, noise cancelers, distortions introduced during silence periods of speech signals are of considerable interest. It is of interest, for example, to determine whether a noise canceler blocks, removes, or reduces background noise in an original signal. More particularly, effects of noise cancellation are most noticeable during non-active, or silent, portions of a speech signal, as these are the portions in which a background signal annoyance is most readily perceived. Therefore, an unmodified PSQM algorithm does not provide a satisfactory indication of noise cancellation effectiveness in a MOS.

It would therefore be desirable to provide methods and apparatus that provide a satisfactory indication of noise cancellation effectiveness. It would further be desirable to provide methods and apparatus that provide a MOS indication of noise cancellation effectiveness. More generally, it would be desirable to provide methods and apparatus for evaluating a measure of MOS for silent periods of any processed speech signal to evaluate the effectiveness and/or usefulness of the processing applied to a speech signal.

BRIEF SUMMARY OF THE INVENTION

The present invention is therefore, in one aspect, a method for evaluating perceptual quality of a processed signal obtained by processing an original signal having silent periods. The method includes steps of determining silent portions and speech portions of the original signal and corresponding silent portions and speech portions of the processed signal, and evaluating the silent portions of the processed signal as a function of amounts of energy contained in the silent portions of the processed signal, corresponding silent portions of the original signal, and an amount of energy in speech portions of the original signal. In one embodiment, the original signal and the processed signal are segmented into frames, frames of the original signal that represent speech and frames of the original signal that represent silence are identified, and the evaluation produces a mean opinion score (MOS). The present invention is, in another aspect, a corresponding device configured to perform steps of an embodiment of the method, and in another aspect, a machine-readable medium configured to instruct a processor to perform steps of an embodiment of the method.

It will be recognized that the present invention, in each of its aspects and embodiments, can be employed to provide measures of noise cancellation effectiveness, and can be used to provide a MOS indication of noise cancellation effectiveness. More generally, the present invention provides evaluations, such as a MOS evaluation, for silent periods of any processed speech signal to evaluate the effectiveness and/or usefulness of the processing applied to a speech signal.

DETAILED DESCRIPTION OF THE INVENTION

Figure 1:
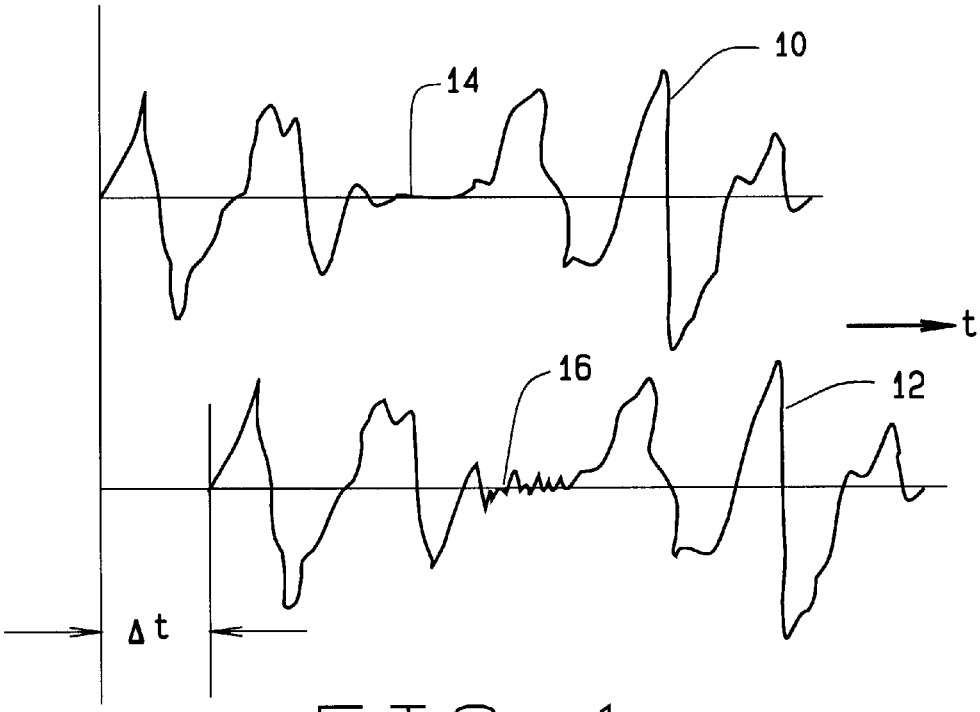
FIG. 1 is a drawing of waveforms representing an original signal and a processed signal in which the signals are offset in the time domain by a difference t.

In one embodiment and referring to FIG. 1, a mean opinion score (MOS) is desired to evaluate processing performed on an original signal 10 to produce a processed version 12 of original signal 10. During processing, distortion of a silent portion 14 of original signal 10 results in a noisy portion 16 of processed signal 12. Original signal 10 and processed version 12 are both available for computing a MOS. However, signals 10, 12 are available in a form in which there is an arbitrary time offset t between them.

Figure 2:
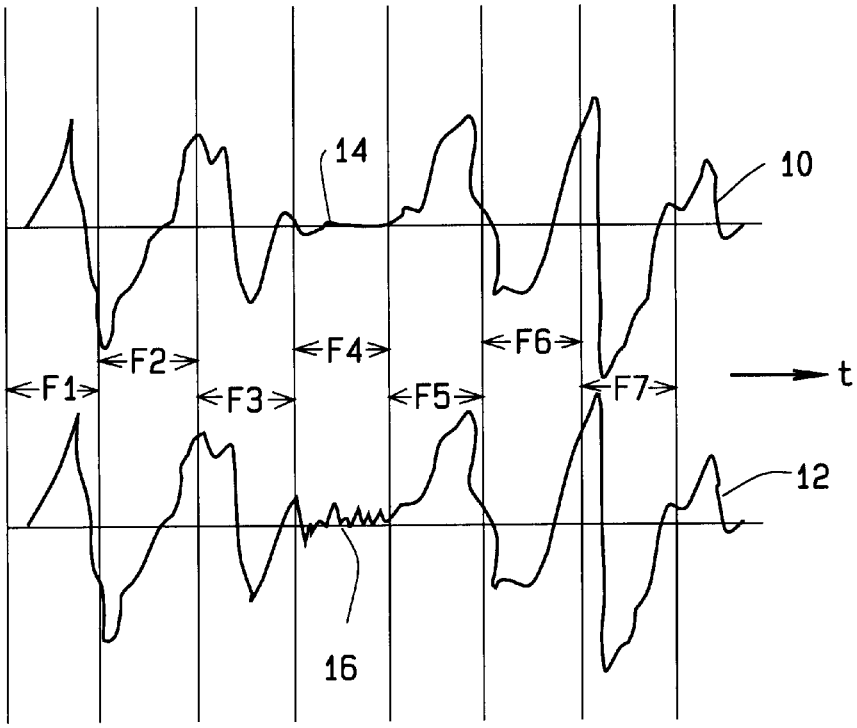
FIG. 2 is a drawing of the waveforms of FIG. 1 aligned in the time domain and segmented into frames.

Referring to FIG. 2, when original signal 10 and processed signal 12 are aligned in time with one another and divided into frames F1, F2, F3, F4, F5, F6, and F7, their relationship becomes more clear. In the example shown in FIG. 2, frames F1, F2, F3, F5, F6, and F7 are frames that correspond to voice or speech portions of original signal 10. Frame F4 corresponds to silent portion 14 of original signal 10 and noisy portion 16 of processed signal 12.

Figure 3:
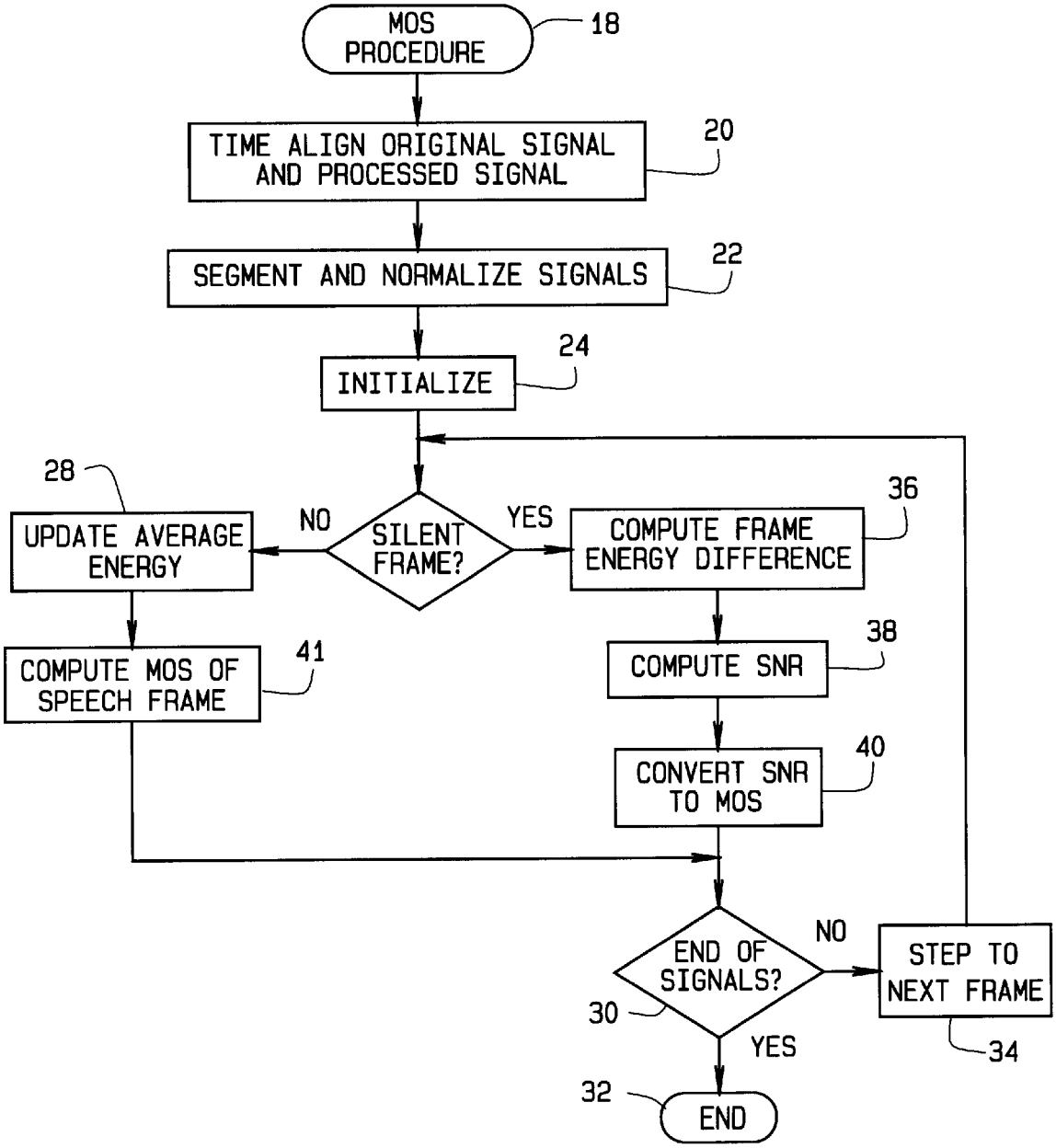
FIG. 3 is a flow chart of an embodiment of a mean opinion score (MOS) procedure.

FIG. 3 is a flow chart of an embodiment of a method 18 for evaluating MOS for silent periods in a voice or speech signal. Initially, original signal 10 and processed signal 12 are time aligned 20, eliminating the time difference t shown in FIG. 1. This alignment can be performed manually or using an algorithm such as ITU P.931. Next, silent portions and speech portions of original signal 10 and corresponding silent portions and speech portions of processed signal 12 are identified. Signals 10 and 12 are divided 22 into corresponding frames as shown in FIG. 2. Each frame represents an interval having a preselected duration determined by the application and resolution required, for example, a duration suitable for capturing pauses between phrases. In one embodiment, the duration is a duration between 10 to 40 milliseconds, and in another, the duration is a duration between 15 to 20 milliseconds. In one embodiment, signals 10 and 12 are also normalized at this point, although in another embodiment, normalization is part of the overall MOS calculation. For example, an overall global scaling is performed as G_global=sqrt(energy of original signal/energy of processed signal).

An initialization 24 is then performed. More specifically, a frame counter is set to examine frame F1, and a variable in which an average energy value is stored and updated is set to zero. A loop that executes a series of statements is then entered.

Upon entering the loop, a check is performed to determine 26 whether the frame of the original signal 10 represents a speech frame of original signal 10 or a silent frame. In one embodiment, this check is performed manually, for example, by observing a waveform of original signal 10 on a computer display. In another embodiment, automatic detection of speech and silent frames is performed using, for example, an ITU P.56 detector algorithm implementation or a detector such as is used in a European Telecommunications Standards Institute/General System for Mobile Communications/Enhanced Full Rate (ETSI/GSM EFR) speech coder, the latter containing a very sophisticated voice activity detector. If the frame checked is not a silent frame, an update of a running average value of energy per speech frame $P_{av}$ is calculated 28. In one embodiment, this update is calculated as $P_{av}(new)=(1-x)\times P_{av}(old)+x\times E_0$, where $P_{av}(new)$ is an updated value of average original signal energy, $P_{av}(old)$ is the previous value of average original signal energy, $E_0$ is an amount of energy in the present frame of original signal 10, and x is a parameter selected to provide low pass filtering, $0<x<1$. In another embodiment, another method for calculating an average original signal energy $P_{av}$ is used. After updating 28, a check is then made to determine 30 whether the frame just checked is the last frame. If so, the procedure terminates 32. If not, it steps 34 to the next frame.

Eventually, a silent frame, for example, frame F4, is detected. In one embodiment, an amount of energy in a difference $E_d$ between original signal 10 and processed signal 12 in this frame is computed 36, according to $P_{av}(new)-P_{av}(old)$ as is an amount of energy $E_0$ in this frame of original signal 10. Using the values of $E_0$, $E_d$, and $P_{av}$, a measure of signal-to-noise ratio (SNR) for the current frame is computed 38, for example, as SNR=10.0×log(original signal energy/processed signal energy)=$10.0\times\log(E_0/E_d)$. The computed SNR value is then converted 40 into a MOS value. This conversion is performed in one embodiment by a table mapping, but in another embodiment, it is adaptively performed, i.e., the mapping has memory and therefore is dependent upon, for example, prior values of SNR and/or MOS. In yet another embodiment, conversion 40 is performed using an empirical expression or formula. The value of MOS is displayed on a computer screen as it is calculated. Each frame F1, F2, F3 . . . is associated with a MOS value. For silent frames such as F3, a MOS value is generated as described above. For speech frames such as F1 and F2, a MOS value is generated 41 using, for example, ITU P.861 PSQM. In one embodiment, a final MOS value is determined as a combination of the MOS values of all of the frames, for example, an average or a weighted average of MOS values.

In one embodiment, SNR computations are improved by explicitly taking into account characteristics of noise within a frame, such as its statistical characteristics. A particular mapping of SNR values into MOS values is then selected, depending upon a type of distortion determined to exist in processed signal 12.

If the frame is determined 30 not to be the last frame, the procedure steps 34 to the next frame. Otherwise, the procedure terminates 32.

In one embodiment, MOS procedure 18 is performed using a suitably programmed personal computer or workstation 42 comprising a system unit 44 having a processor (not shown), a computer display 46, and input devices such as a keyboard 48 and a mouse 50. A program including MOS procedure 18 is provided on computer readable media. For example, a floppy diskette (not shown) is read by a disk drive 52 of computer 44. The floppy diskette has recorded thereon signals representative of processor instructions to execute MOS procedure 18.

In another embodiment, workstation 42 is programmed in a different manner, for example, as a dedicated workstation containing the procedure in firmware, or as a diskless network workstation, relying upon a remote server (not shown) for programming. In one embodiment, the program including MOS procedure 18 includes various interface enhancements to provide convenient user control via computer in keyboard 48 and/or mouse 50. For example, graphical representations of original signal 10 and processed signal 12 are displayed simultaneously on computer display 46 in distinctive colors and manipulated on display 46 by the user, using keyboard 48 and/or mouse 50. The user correlates signals 10 and 12 in the time domain to manually align data corresponding to signals 10 and 12.

Figure 4:
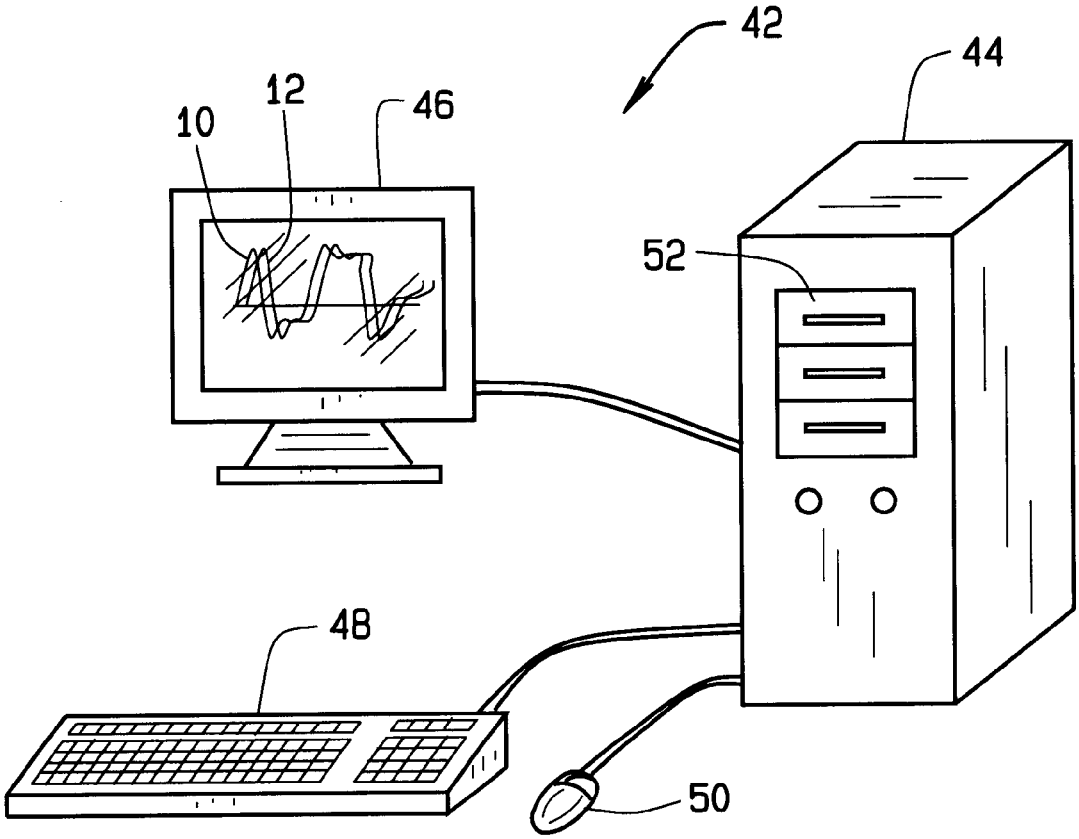
FIG. 4 is a pictorial diagram of a workstation for executing the procedure of FIG. 3.

In another embodiment not illustrated in FIG. 4, MOS procedure 18 is embedded as firmware or hardware of a special purpose signal processor operating in real time on original signal 10 and processed signal 12. Time alignment of signals is not necessary as a separate step when original signal 10 and processed signal 12 are provided simultaneously without significant differential delay, and when the special purpose signal processor is sufficiently powerful to process MOS measurements in real time, as the signals are received. Those skilled in the art will recognize that embodiments utilizing linear, rather than digital, signal processing are possible.

For economy of expression, the terms "original signal" and "processed signal" are used extensively herein. However, it is to be understood that these terms are also intended to encompass representations of an original signal and a processed signal, respectively. Similarly, where reference is made to other signals, such references are also intended to encompass representations of such other signals. Representations of signals are intended to include analog and digital representations, unless otherwise noted.

From the preceding description of various embodiments of the present invention, it is evident that the present invention, in each of its aspects and embodiments, can be employed to provide measures of noise cancellation effectiveness, and can be used to provide a MOS indication of noise cancellation effectiveness. More generally, the present invention provides evaluations, such as a MOS evaluation, for silent periods of any processed speech signal to evaluate the effectiveness and/or usefulness of the processing applied to a speech signal.

Although the invention has been described and illustrated in detail, it is to be clearly understood that the same is intended by way of illustration and example only and is not to be taken by way of limitation. Accordingly the spirit and scope of the invention are to be limited only by the terms of the appended claims and their equivalents.

What is claimed is:

1. A method for evaluating perceptual quality of a processed signal obtained by processing an original signal having silent periods, said method comprising the steps of:

determining silent portions and speech portions of the original signal and corresponding silent portions and speech portions of the processed signal; and evaluating the silent portions of the processed signal as a function of amounts of energy contained in the silent portions of the processed signal, corresponding silent portions of the original signal, and an amount of energy in speech portions of the original signal.

2. A method in accordance with claim 1 wherein determining silent portions and speech portions of the original signal and corresponding silent portions and speech portions of the processed signal comprises the steps of:

segmenting the original signal into frames;

segmenting the processed signal into corresponding frames; and identifying frames of the original signal that represent speech and frames of the original signal that represent silence, such frames therefore being speech frames and silent frames, respectively.

3. A method in accordance with claim 2 wherein frames of the original signal that represent speech and frames that represent silence are manually identified.

4. A method in accordance with claim 2 wherein identifying frames of the original signal that represent speech and frames of the original signal that represent silence comprises differentiating frames of the original signal into speech frames and silent frames utilizing an International Telecommunications Union (ITU) P.56 processor.

5. A method in accordance with claim 2 wherein identifying frames of the original signal that represent speech and frames of the original signal that represent silence comprises differentiating frames of the original signal into speech frames and silent frames utilizing a European Telecommunications Standards Institute/General System for Mobile Communications/Enhanced Full Rate (ETSI/GSM EFR) speech coder.

6. A method in accordance with claim 2 further comprising computing a running average value of energy per speech frame of the original signal, and wherein evaluating silent portions of the processed signal comprises evaluating a frame of the processed signal corresponding to a silent frame of the original signal as a function of an amount of energy contained within the silent frame of the original signal, an amount of energy contained within the silent frame of the processed signal, and a current running average value of energy per speech frame of the original signal.

7. A method in accordance with claim 6 wherein computing a running average value of energy per speech frame of the original signal comprises computing a running average value of energy per speech frame of the original signal utilizing a low pass filter.

8. A method in accordance with claim 6 wherein computing a running average value of energy per speech frame of the original signal comprises computing a running average value of energy per speech frame of the original signal in accordance with $P_{av}(\text{new})=(1-x)\times P_{av}(\text{old})+x\times E_0$, where:

$P_{av}(\text{new})$ is a current running average value of energy per speech frame of the original signal;

$P_{av}(\text{old})$ is a previous running average value of energy per speech frame of the original signal;

$E_0$ is a value of energy in a current speech frame of the original signal; and $0<x<1$.

9. A method in accordance with claim 6 wherein evaluating silent portions of the processed signal further comprises:

generating a difference signal representative of a difference between the silent frame of the original signal and the corresponding frame of the processed signal;

computing an amount of energy in the silent frame of the original signal and an amount of energy in the difference signal; and computing a signal-to-noise ratio as a function of the amount of energy in the silent frame of the original signal, the amount of energy in the difference signal, and the current running average value of energy per speech frame of the original signal.

10. A method in accordance with claim 9 further comprising the step of converting the signal-to-noise ratio into a mean opinion score (MOS) value.

11. A method in accordance with claim 10 further comprising the step of analyzing the processed signal and the original signal to determine a type of distortion present in the processed signal, and wherein converting the signal-to-noise ratio into a MOS value comprises the step of selecting a mapping of signal-to-noise ratios into MOS values in accordance with the type of distortion determined to be present in the processed signal.

12. A method in accordance with claim 10 wherein converting the signal-to-noise ratio into a MOS value is performed for each silent frame of the original signal, and the conversion is an adaptive conversion.

13. A method in accordance with claim 10 wherein converting the signal-to-noise ratios into an MOS value comprises looking up a MOS value in a table indexed by signal-to-noise ratio values.

14. A method in accordance with claim 2 wherein segmenting the original signal into frames comprises segmenting the original signal into frames having equal, predetermined durations.

15. A method in accordance with claim 14 wherein the equal, predetermined durations are between 10 and 40 milliseconds.

16. A method in accordance with claim 14 wherein the equal, predetermined durations are between 15 and 20 milliseconds.

17. A method in accordance with claim 1 wherein determining silent portions and speech portions of the original signal and corresponding silent portions and speech portions of the processed signal comprises the step of manually aligning time-domain representations of the original signal and the processed signal.

18. A method in accordance with claim 1 wherein determining silent portions and speech portions of the original signal and corresponding silent portions and speech portions of the processed signal comprises the step of computing a time-domain alignment of the original signal and the processed signal.

19. A method in accordance with claim 18 wherein computing a time-domain alignment of the original signal and the processed signal comprises computing an alignment of the original signal and the processed signal utilizing (International Telecommunications Union) ITU algorithm P.931.

20. A system for evaluating perceptual quality of a processed signal obtained by processing an original signal having silent periods, said system configured to:

determine silent portions and speech portions of the original signal and corresponding silent portions and speech portions of the processed signal; and evaluate the silent portions of the processed signal as a function of amounts of energy contained in corresponding silent portions of the original signal and an amount of energy in speech portions of the original signal.

21. A system in accordance with claim 20 wherein said system being configured to determine silent portions and speech portions of the original signal and corresponding silent portions and speech portions of the processed signal comprises said system being configured to:

segment the original signal into frames;

segment the processed signal into corresponding frames; and identify frames of the original signal that represent speech and frames of the original signal that represent silence, such frames therefore being speech frames and silent frames, respectively.

22. A system in accordance with claim 21 wherein said system comprises an International Telecommunications Union (ITU) P.56 processor to identify frames of the original signal that represent speech and frames of the original signal that represent silence.

23. A system in accordance with claim 21 wherein said system comprises a European Telecommunications Standards Institute/General System for Mobile Communications/Enhanced Full Rate (ETSI/GSM EFR) speech coder to identify frames of the original signal that represent speech and frames of the original signal that represent silence.

24. A system in accordance with claim 21 further configured to compute a running average value of energy per speech frame of the original signal, and wherein said system being configured to evaluate silent portions of the processed signal comprises said system being configured to evaluate the silent portions of the processed signal as a function of amounts of energy contained in the silent portions of the processed signal, corresponding silent portions of the original signal, and an amount of energy in speech portions of the original signal.

25. A system in accordance with claim 24 wherein said system being configured to compute a running average value of energy per speech frame of the original signal comprises said system being configured to compute a running average value of energy per speech frame of the original signal utilizing a low pass filter.

26. A system in accordance with claim 24 wherein said system being configured to compute a running average value of energy per speech frame of the original signal comprises said system being configured to compute a running average value of energy per speech frame of the original signal in accordance with $P_{av}(new)=(1-x)\times P_{av}(old)+x\times E_0$, where:

$P_{av}(new)$ is a current running average value of energy per speech frame of the original signal;

$P_{av}(old)$ is a previous running average value of energy per speech frame of the original signal;

$E_0$ is a value of energy in a current speech frame of the original signal; and $0<x<1$.

27. A system in accordance with claim 24 wherein said system being configured to evaluate silent portions of the processed signal further comprises said system being configured to:

generate a difference signal representative of a difference between the silent frame of the original signal and the corresponding frame of the processed signal;

compute an amount of energy in the silent frame of the original signal and an amount of energy in the difference signal; and compute a signal-to-noise ratio as a function of the amount of energy in the silent frame of the original signal, the amount of energy in the difference signal, and the current running average value of energy per speech frame of the original signal.

28. A system in accordance with claim 27 further configured to convert the signal-to-noise ratio into a mean opinion score (MOS) value.

29. A system in accordance with claim 28 further configured to analyze the processed signal and the original signal to determine a type of distortion present in the processed signal, and wherein said system being configured to convert the signal-to-noise ratio into a MOS value comprises said system being configured to select a mapping of signal-to-noise ratios into MOS values in accordance with the type of distortion determined to be present in the processed signal.

30. A system in accordance with claim 28 wherein said system is configured to convert the signal-to-noise ratio into a MOS value for each silent frame of the original signal, and to perform the conversion adaptively.

31. A system in accordance with claim 28 wherein said system is configured to look up a MOS value in a table indexed by signal-to-noise ratio values.

32. A system in accordance with claim 19 wherein said system is configured to segment the original signal into frames having equal durations.

33. A system in accordance with claim 32 wherein said equal durations are between 10 and 40 milliseconds.

34. A system in accordance with claim 32 wherein said equal durations are between 15 and 20 milliseconds.

35. A system in accordance with claim 20 wherein said system being configured to determine silent portions and speech portions of the original signal and corresponding silent portions and speech portions of the processed signal comprises said system being configured to compute a time-domain alignment of the original signal and the processed signal.

36. A system in accordance with claim 35 wherein said system is configured to compute a time-domain alignment of the original signal and the processed signal utilizing (International Telecommunications Union) ITU algorithm P.931.

37. A machine-readable medium for a computer having signals recorded thereon for instructing a processor to evaluate perceptual quality of a processed signal obtained by processing an original signal having silent periods, said signals including instructions for said processor to:

determine silent portions and speech portions of the original signal and corresponding silent portions and speech portions of the processed signal; and evaluate the silent portions of the processed signal as a function of amounts of energy contained in the silent portions of the processed signal, corresponding silent portions of the original signal, and an amount of energy in speech portions of the original signal.

38. A machine-readable medium in accordance with claim 37 wherein said instructions to determine silent portions and speech portions of the original signal and corresponding silent portions and speech portions of the processed signal comprises instructions to:

segment the original signal into frames;

segment the processed signal into corresponding frames; and identify frames of the original signal that represent speech and frames of the original signal that represent silence, such frames therefore being speech frames and silent frames, respectively.

39. A machine-readable medium in accordance with claim 38 wherein said instructions further include instructions to compute a running average value of energy per speech frame of the original signal, and said instructions to evaluate silent portions of the processed signal comprise instructions to evaluate a frame of the processed signal corresponding to a silent frame of the original signal as a function of an amount of energy contained within the silent frame of the original signal, an amount of energy contained within the silent frame of the processed signal, and a current running average value of energy per speech frame of the original signal.

40. A machine-readable medium in accordance with claim 39 wherein said instructions to compute a running average value of energy per speech frame of the original signal comprises instructions to compute a running average value of energy per speech frame of the original signal utilizing a low pass filter.

41. A machine-readable medium in accordance with claim 39 wherein said instructions to compute a running average value of energy per speech frame of the original signal comprises instructions to compute a running average value of energy per speech frame of the original signal in accordance with $P_{av}(new)=(1-x)\times P_{av}(old)+x\times E_0$, where:

$P_{av}(new)$ is a current running average value of energy per speech frame of the original signal;

$P_{av}(old)$ is a previous running average value of energy per speech frame of the original signal;

$E_0$ is a value of energy in a current speech frame of the original signal; and $0<x<1$.

42. A machine-readable medium in accordance with claim 39 wherein said instructions to evaluate silent portions of the processed signal include instructions to:

generate a difference signal representative of a difference between the silent frame of the original signal and the corresponding frame of the processed signal;

compute an amount of energy in the silent frame of the original signal and an amount of energy in the difference signal; and compute a signal-to-noise ratio as a function of the amount of energy in the silent frame of the original signal, the amount of energy in the difference signal, and the current running average value of energy per speech frame of the original signal.

43. A machine-readable medium in accordance with claim 42 wherein said instructions further comprise instructions to convert the signal-to-noise ratio into a mean opinion score (MOS) value.

44. A machine-readable medium in accordance with claim 43 wherein said instructions further comprise instructions to analyze the processed signal and the original signal to determine a type of distortion present in the processed signal, and wherein said instructions to convert the signal-to-noise ratio into a MOS value comprise instructions to select a mapping of signal-to-noise ratios into MOS values in accordance with the type of distortion determined to be present in the processed signal.

45. A machine-readable medium in accordance with claim 43 wherein said instructions include instructions to convert the signal-to-noise ratio into a MOS value for each silent frame of the original signal, and to perform the conversion adaptively.

46. A machine-readable medium in accordance with claim 43 wherein said instructions include instructions to look up a MOS value in a table indexed by signal-to-noise ratio values.

47. A machine-readable medium in accordance with claim 38 wherein said instructions include instructions to segment the original signal into frames having equal durations.

48. A machine-readable medium in accordance with claim 47 wherein said equal durations are between 10 and 40 milliseconds.

49. A machine-readable medium in accordance with claim 47 wherein said equal durations are between 15 and 20 milliseconds.

50. A machine-readable medium in accordance with claim 37 wherein said instructions to determine silent portions and speech portions of the original signal and corresponding silent portions and speech portions of the processed signal comprises instructions to compute a time-domain alignment of the original signal and the processed signal.

51. A machine-readable medium in accordance with claim 50 wherein said instructions include instructions to compute a time-domain alignment of the original signal and the processed signal utilizing (International Telecommunications Union) ITU algorithm P.931.

* * * * *